US009649772B2

(12) United States Patent
Shimizu

(10) Patent No.: US 9,649,772 B2
(45) Date of Patent: May 16, 2017

(54) ROTARY ELECTRIC SHAVER

(71) Applicant: Izumi Products Company, Matsumoto-shi, Nagano (JP)

(72) Inventor: Tetsuhiko Shimizu, Matsumoto (JP)

(73) Assignee: IZUMI PRODUCTS COMPANY, Matsumoto-shi (JP)

( * ) Notice: Subject to any disclaimer, the term of this patent is extended or adjusted under 35 U.S.C. 154(b) by 78 days.

(21) Appl. No.: 14/285,745

(22) Filed: May 23, 2014

(65) Prior Publication Data

US 2014/0352152 A1 Dec. 4, 2014

(30) Foreign Application Priority Data

Jun. 4, 2013 (JP) ..... 2013-117771

(51) Int. Cl.
*B26B 19/14* (2006.01)

(52) U.S. Cl.
CPC ..... *B26B 19/146* (2013.01)

(58) Field of Classification Search
CPC ..... B26B 19/146; B26B 19/14; B26B 19/38; B26B 19/141
USPC ..... 30/43.6, 527, 42, 43.4, 346.51, 43.5, 43, 30/43.1, 43.2, 87, 89, 346.5, 45; 29/592.1
See application file for complete search history.

(56) References Cited

U.S. PATENT DOCUMENTS 1,959,307 A * 5/1934 Sanger ..... A47L 13/34 15/23
2,194,815 A 3/1940 Testi
4,494,548 A * 1/1985 Buon ..... G10K 11/355 600/446
4,574,481 A * 3/1986 Ericsson ..... B27B 17/00 244/4 A
4,733,466 A * 3/1988 Fletcher, Jr. ..... B26B 19/141 30/34.2
5,433,667 A * 7/1995 Schafer ..... F16D 3/32 464/118
7,020,965 B2 * 4/2006 Bao ..... B26B 19/14 30/43.5
2008/0034591 A1 * 2/2008 Fung ..... B26B 19/02 30/43.92
2008/0092393 A1 * 4/2008 Van Der Meer ..... B26B 19/146 30/43.6
2010/0287784 A1 11/2010 Qui
(Continued)

FOREIGN PATENT DOCUMENTS

EP 0 543 460 A 5/1993
JP 2011-30982 A 2/2011
JP 2011-98041 A 5/2011

*Primary Examiner* — Ghassem Alie
(74) *Attorney, Agent, or Firm* — Birch, Stewart, Kolasch & Birch, LLP

(57) ABSTRACT

In a rotary electric shaver according to the present invention, a plurality of blade units that include an outer blade having an annular shaving surface on an upper surface and an inner blade rotating in sliding contact with a lower surface of the outer blade are arranged in a head unit held by a main body so as to be tiltable. A main drive shaft outputting drive force of a motor accommodated in the main body and a rotary shaft of any one blade unit out of the plurality of blade units are connected by a movable joint, and a position of the movable joint serves as a tilting fulcrum for tilting the head unit.

5 Claims, 3 Drawing Sheets

(56) References Cited

U.S. PATENT DOCUMENTS

| | | | | |
|---|---|---|---|---|
| 2011/0030220 | A1* | 2/2011 | Shimizu | B26B 19/14 30/43.6 |
| 2011/0113632 | A1* | 5/2011 | Bao | B26B 19/14 30/43 |

* cited by examiner

ROTARY ELECTRIC SHAVER

CROSS-REFERENCE TO RELATED APPLICATION

This application is based upon and claims the benefit of priority of the prior Japanese Patent Application No. P2013-117771, filed on Jun. 4, 2013, and the entire contents of which are incorporated herein by reference.

FIELD

The present invention relates to a rotary electric shaver.

BACKGROUND

As disclosed in PTL 1 for example, a rotary electric shaver has been known in which a plurality of blade units including an outer blade having an annular shaving surface on an upper surface and an inner blade rotating in sliding contact with a lower surface of the outer blade are arranged in a head unit held by a main body.

CITATION LIST

Patent Literature

PTL 1: JP-A-2011-30982

SUMMARY

Technical Problem

Here, a rotary electric shaver disclosed in PTL 1 as an example has a configuration in which a fulcrum for tilting a head unit is disposed at a central position of a plurality of blade units (in this case, a set of three blade units). According to the configuration, there are problems in that an operation range (angular range) for a tilting operation of the head unit is narrow and in that the tilting operation of the head unit is not smooth since large force (applying force) is required for the tilting operation.

The present invention is made in view of the above-described circumstances, and an object thereof is to provide a rotary electric shaver which allows a head unit to have a wide operation range (angular range) for the tilting operation, which can tilt the head unit using smaller force, and which can accordingly improve a shaving performance and shaving comfort by improving an ability to match a user's skin.

Solution to Problem

In an embodiment, a solution disclosed herein will solve the above-described problem.

A rotary electric shaver disclosed herein meets the following requirements. A plurality of blade units that include an outer blade having an annular shaving surface on an upper surface and an inner blade rotating in sliding contact with a lower surface of the outer blade are arranged in a head unit held by a main body so as to be tiltable. A main drive shaft outputting drive force of a motor accommodated in the main body and a rotary shaft of any one blade unit out of the plurality of blade units are connected by a movable joint, and a position of the movable joint serves as a tilting fulcrum for tilting the head unit.

Advantageous Effects

According to the rotary electric shaver disclosed herein, it is possible to allow the head unit to have a wide operation range (angular range) for the tilting operation, and it is possible to tilt the head unit by using smaller force. That is, the head unit is allowed to smoothly move in the wide angular range, thereby improving the ability to match the user's skin. In this manner, it is possible to improve the shaving performance and the shaving comfort.

DESCRIPTION OF THE EMBODIMENTS

Figure 1A:
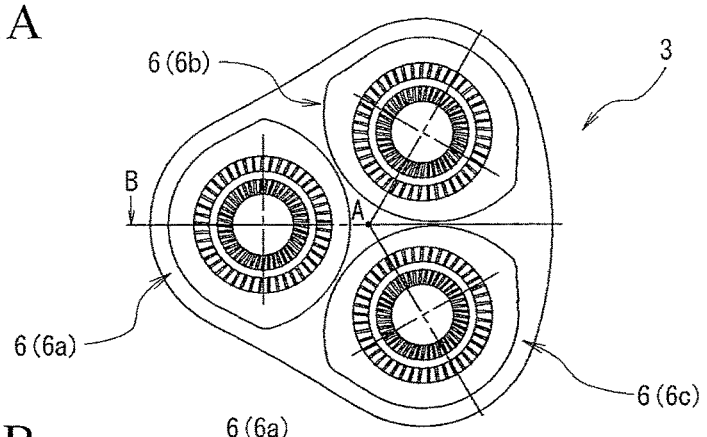
FIGS. 1A and 1B are schematic views illustrating an example of a rotary electric shaver according to an embodiment of the present invention.
Figure 1B:
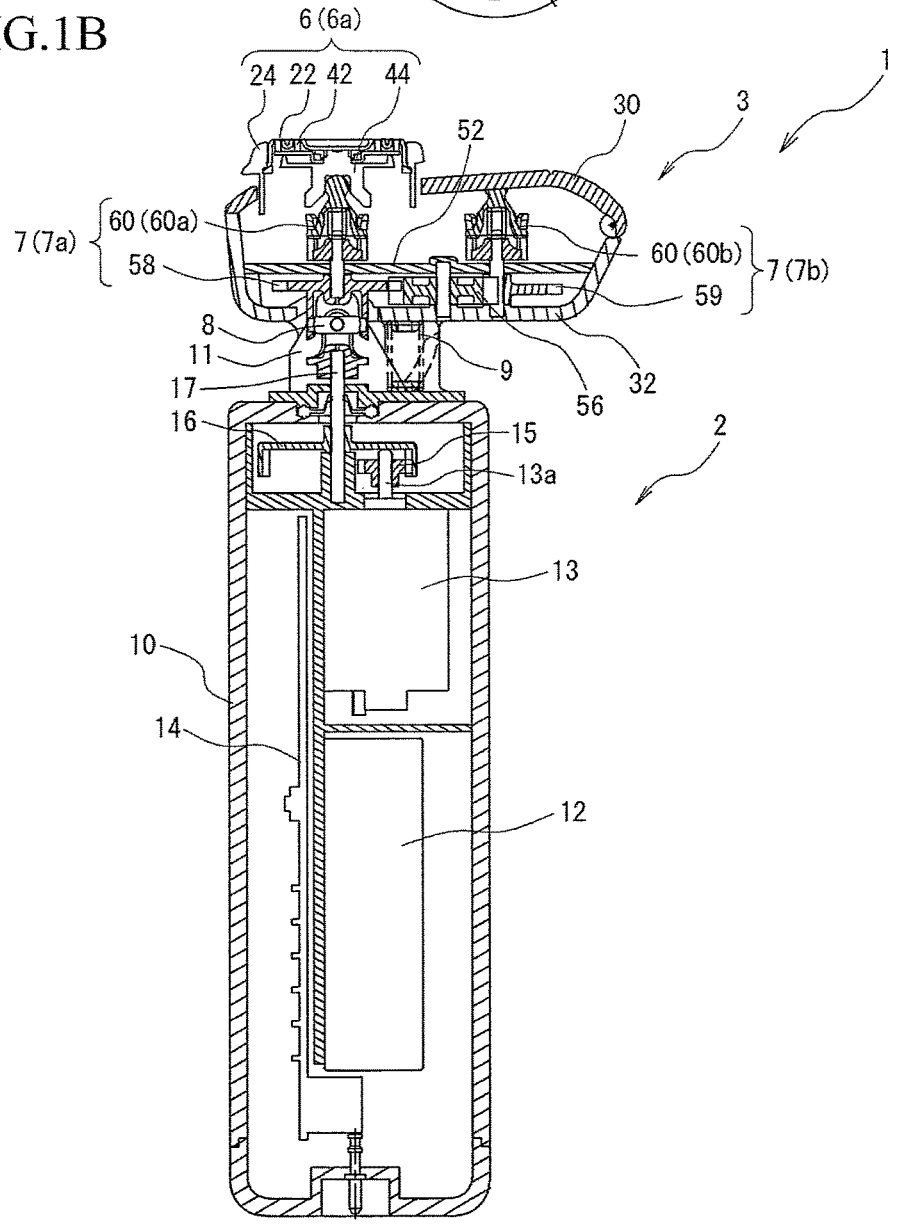
Figure 2:
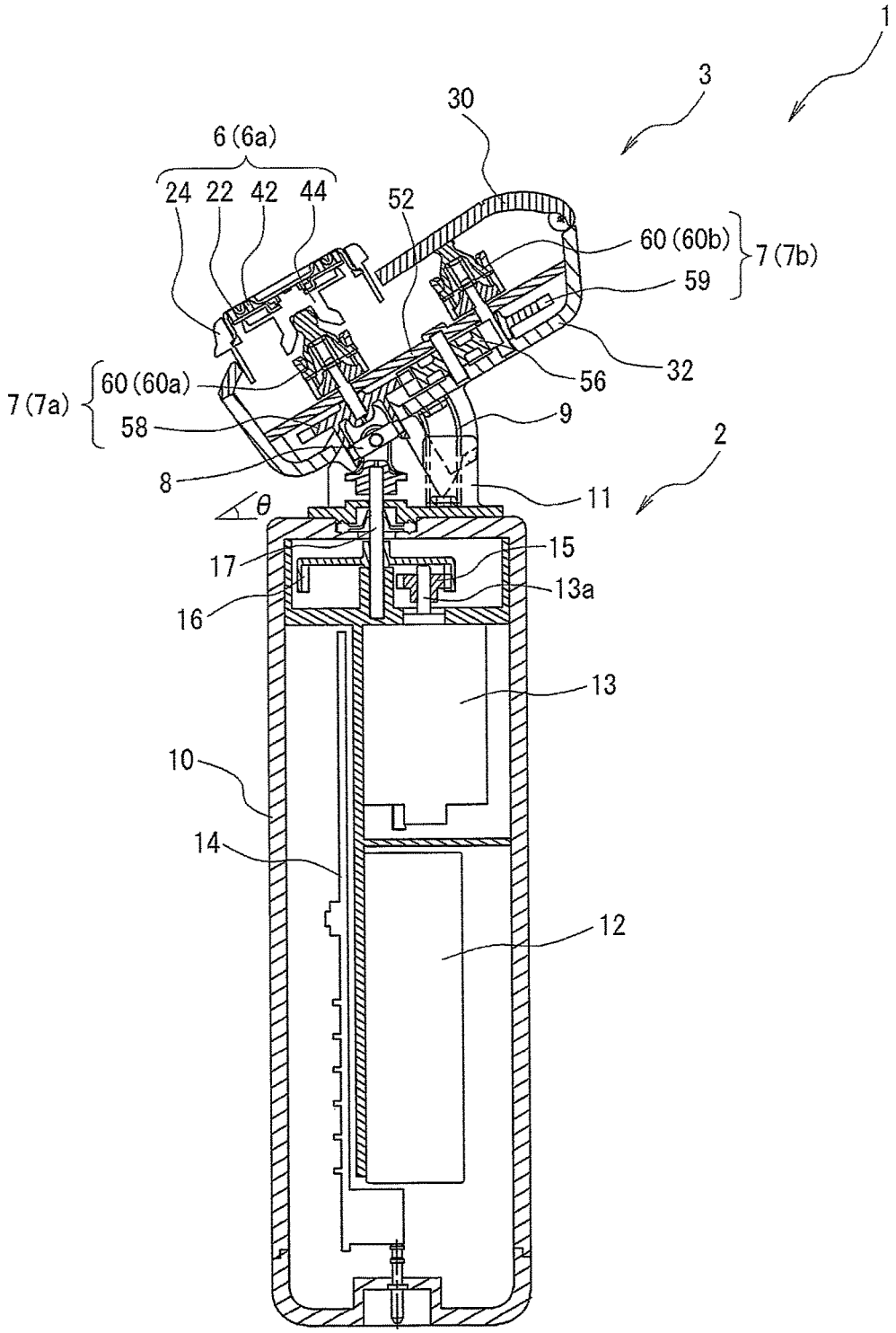
FIG. 2 is a schematic view for illustrating an operation of a head unit of the rotary electric shaver illustrated in FIGS. 1A and 1B.

Hereinafter, an embodiment of the present invention will be described in detail with reference to the drawings. FIGS. 1A and 1B are schematic views illustrating an example of a rotary electric shaver 1 according to the embodiment of the present invention. FIG. 1A is a plan view and FIG. 1B is a side view (cross-sectional view). In addition, FIG. 2 is a side view (cross-sectional view) for illustrating an operation (tilting operation) of a head unit of the rotary electric shaver 1. In all the drawings for illustrating the embodiment, the same reference signs are given to members having the same function, and in some cases, repetitive description thereof will be omitted.

As illustrated in FIGS. 1A-2, the rotary electric shaver 1 according to the present embodiment includes an outer blade 22 having an annular shaving surface on an upper surface where multiple beard inlets are formed, and an inner blade 42 with a small blade which rotates while coming into sliding contact with a lower surface of the outer blade 22. The rotary electric shaver 1 cuts beards entering the beard inlets by using the outer blade 22 and the inner blade 42. The rotary electric shaver 1 having three sets of a blade unit 6 configured to include the outer blade 22 and the inner blade 42 will be described as an example, but the present embodiment is not limited thereto.

The reference sign 2 in FIGS. 1A-2 represents a main body which includes a case 10 having a substantially cylindrical shape. The case 10 internally accommodates a battery 12, a motor 13, a control circuit board 14 and the like. A power switch (not illustrated) is attached to a front surface of the case 10, and a display unit (not illustrated) formed to have an LED lamp indicating residual capacity and an operation state of the battery is disposed below the power switch. The battery 12 in the present embodiment is a rechargeable battery, but may be configured to employ a dry cell.

In addition, a main drive shaft 17 outputting drive force for rotatably driving the inner blade 42 of the blade unit 6 is arranged to protrude toward a head unit (to be described later) from an upper surface of the case 10. The main drive shaft 17 is connected to an output shaft 13*a* of the motor via a pinion gear 15 and a reduction gear 16.

Figure 3:
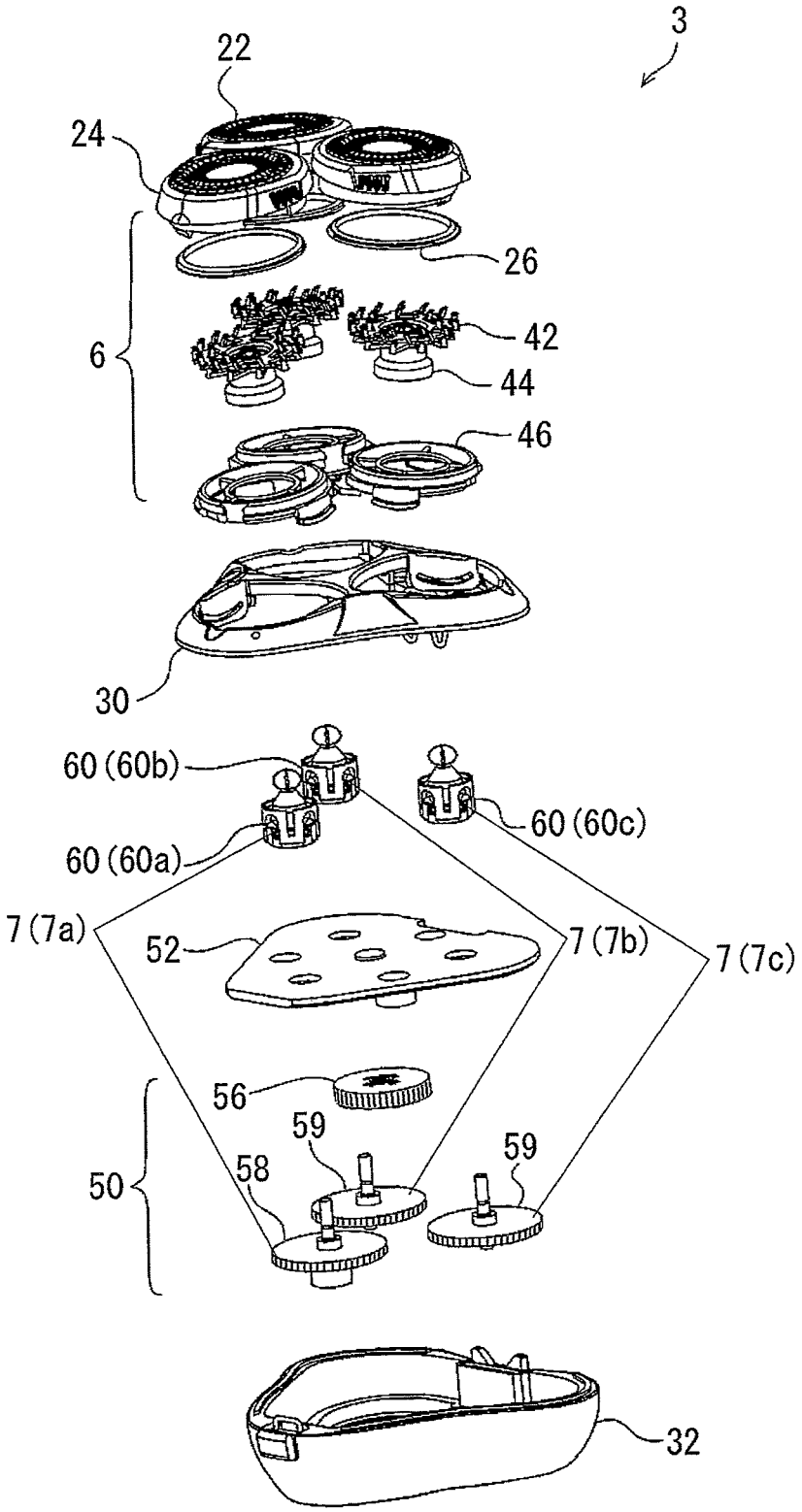
FIG. 3 is a schematic view (exploded perspective view) illustrating a structure of the head unit of the rotary electric shaver illustrated in FIGS. 1A and 1B.

The reference sign 3 in FIGS. 1A-2 represents the head unit. As a characteristic configuration in the present embodiment, the head unit 3 is held by the main body 2 so as to be tiltable. Here, a detailed structure of the head unit 3 is illustrated in an exploded perspective view in FIG. 3.

As illustrated in FIGS. 1A-3, the head unit 3 includes a head case 32 held by being connected to a connection case 11 disposed on the upper surface of the case 10 of the main body 2, a blade frame 30 covering the head case 32 from above, a drive mechanism 50 accommodated in an inner bottom portion of the head case 32, and three sets of the blade unit 6 held by the blade frame 30 so as to be slightly and vertically movable and swingable. Each blade unit 6 includes the outer blade 22 having a substantially disk shape and the inner blade 42 rotating while coming into sliding contact with an inner surface of the outer blade 22. In addition, in a plan view, three sets of the blade unit 6 are arranged at equal intervals in a circumferential direction with respect to a center point A of a rotary shaft of each blade unit (refer to FIG. 1A). The present embodiment is an example when three sets of the blade unit 6 are provided as described above, but a basic configuration is considered to be the same as when four sets or more of the blade unit are provided.

The drive mechanism 50 is accommodated between a bottom surface of the head case 32 and a support plate 52 which is held by leaving a space above the bottom surface. More specifically, a driving gear 58 is provided which is connected to an upper end of the main drive shaft 17 via a movable joint 8. Furthermore, there are provided two driven gears 59 which are connected to (mesh with) the driving gear 58 via a connection gear 56. The driving gear 58, the connection gear 56, and the driven gears 59 are rotatably supported by the head case 32 and the support plate 52. A Cardan joint is used as the movable joint 8 according to the present embodiment. However, the present embodiment is not limited to this configuration, and for example, other universal joints such as a spherical joint may be used.

A shaft of the driving gear 58 of the drive mechanism 50 protrudes from the support plate 52 and an inner blade drive shaft 60 (60*a*) of one blade unit is combined with a protruding portion thereof. The inner blade drive shaft 60 has a spherical portion on an upper end, and is provided with a resetting tendency in a direction extended by a compressed coil spring which is internally installed therein. The resetting tendency serves as pressing force against the outer blade 22 of the inner blade 42 (to be described later). In the present embodiment, a combined body of the driving gear 58 and the inner blade drive shaft 60 (60*a*) is referred to as a rotary shaft 7 (7*a*) of the blade unit 6 (6*a*).

In this manner, the configuration including the movable joint 8 enables the inner blade 42 to be driven by transmitting drive force of the main drive shaft 17 to the rotary shaft 7 (7*a*) of the blade unit 6 (6*a*), even when the head unit 3 is tilted with respect to the main body 2 (details to be described later).

In addition, in the same manner, shafts of the driven gears 59 and 59 of the drive mechanism 50 protrude from the support plate 52, and the inner blade drive shafts 60 (60*b*) and 60 (60*c*) of the other blade unit are respectively combined with protruding portions thereof. In the same manner as described above, in the present embodiment, combined bodies of the driven gears 59 and 59 and the inner blade drive shafts 60 (60*b*) and 60 (60*c*) are referred to as the rotation shafts 7 (7*b*) and 7 (7*c*) of the respective blade units 6 (6*b*) and 6 (6*c*).

The inner blade drive shaft 60 engages with the inner blade 42 via the above-described spherical portion. That is, this upper end spherical portion of the inner blade drive shaft 60 is inserted into a recess which is formed in an inner blade holder 44 of the inner blade 42 and is opened downward, from below, and the inner blade drive shaft 60 is engaged therewith so as to be swingable. The engagement structure is an example, and other joint structures may be employed.

An upper surface of the outer blade 22 has multiple radial slits, and the beards entering the slits are cut by the inner blade 42. A peripheral edge of the outer blade 22 is bent downward and an outer blade ring 24 is fitted to the peripheral edge. A stopper ring 26 is fitted to an inner periphery of the outer blade ring 24 so as to fix the outer blade 22 to the outer blade ring 24.

The inner blade 42 is fixed to the inner blade holder 44, and a recess into which the upper end (spherical portion) of the inner blade drive shaft 60 is inserted to be engaged therewith is formed in a lower portion of the inner blade holder 44. The inner blade 42 is held to be swingable to the outer blade 22 side by an inner blade rest 46 fitted to the outer blade ring 24, and these form three sets of the independent blade unit 6.

Here, in the present embodiment, the head unit is configured to be connected and supported so as to be tiltable with respect to the connection case 11 arranged on an upper surface of the main body 2. That is, as is apparent from comparison between FIGS. 1A-2, the head unit 3 connected to and supported by the main body 2 (here, the connection case 11 on the upper surface of the case 10) is adapted to be tiltable within a predetermined operation range (within a range of a predetermined angle θ). The angle θ represents a tilting angle of a lower surface of the head unit 3 with respect to the upper surface of the main body 2 (refer to FIG. 2).

In this case, a position of the movable joint 8 is configured to serve as a tilting fulcrum for tilting the head unit 3. That is, the head unit 3 can perform a tilting operation around the center (fulcrum) of the position of the movable joint 8. According to this configuration, it is possible to solve a problem occurring in the rotary electric shaver in the related art, such as a problem in a configuration of disposing a fulcrum for tilting a head unit at center positions of the plurality of blade units, that is, a problem of a narrow operation range for the tilting operation of the head unit.

More specifically, a configuration is realized where the main drive shaft 17 and the rotary shaft 7*a* of one blade unit 6 (in the present embodiment, the blade unit 6*a* in FIG. 1A) are connected to each other by the movable joint 8, and the position of the movable joint 8 serves as the center (fulcrum) of the tilting operation for the head unit 3. As illustrated in FIGS. 1A-2, as compared to the electric shaver in the related art, this configuration can provide an extremely wide range for the tilting operation of the head unit 3 (range of the angle θ) without increasing a clearance dimension (dimension in a case of θ=0) between the upper surface of the main body 2 and the lower surface of the head unit 3. As a result, it is possible to improve an ability of the shaving surface (upper surface of the outer blade) of the head unit to match a user's skin. Therefore, it is possible to significantly improve a shaving performance and shaving comfort. As an example, the range of the angle θ is set to be $0[°] \leq \theta \leq 30[°]$. However, the present embodiment is not limited to this angular range.

In addition, as described above, without increasing the clearance dimension between the main body 2 and the head unit 3, it is possible to realize the widened tilting range for the head unit 3. Therefore, it is possible to obtain a more compact electric shaver as a whole, and consequently, it is possible to enhance freedom of design.

With regard to a direction of the tilting operation, the head unit 3 is held by the main body 2 so as to perform the tilting operation within an inner surface (in the present embodiment, inside a surface B in FIG. 1A) including a central axis of the rotary shaft 7*a* of the blade unit 6*a* to which the main drive shaft 17 is connected and a central axis of the rotary shaft of the blade unit farthest from the blade unit 6*a* (in the present embodiment, since there are two farthest blade units 6*b* and 6*c*, this case corresponds to a midpoint between the central axes of the respective rotary shafts 7*b* and 7*c*). The direction of the tilting operation is not limited to the above. For example, if the spherical joint is used as the movable joint 8, it is possible to realize a configuration which enables an omnidirectional operation (three-dimensional operation) (not illustrated).

According to the above-described configuration, the position for disposing the fulcrum for the tilting operation of the head unit 3 (here, on the central axis of the rotary shaft 7*a* of the blade unit 6*a* to which the main drive shaft 17 is connected) can be eccentrically moved in a direction of an outer edge position from center positions of the plurality of blade units 6*a*, 6*b* and 6*c*. That is, as compared to the configuration in the related art, it is possible to adapt a point from which force is applied to perform the tilting operation (reaction force when the shaving surface of the head unit 3 is pressed against the user's skin) to be located at a position farther from the fulcrum of the tilting operation. Accordingly, it is possible to easily tilt the head unit 3 by using smaller force. Therefore, it is possible to realize a smooth tilting operation of the head unit 3, and thus, it is possible to enhance an ability of the head unit 3 to come into close contact with the skin.

The present embodiment further includes a biasing member 9 which biases the head unit 3 so as to hold the head unit 3 at a position where the above-described tilting angle θ is maximized within a setting range. The biasing member 9 may be a coil spring as an example. One end of the biasing member is fixed to the upper surface of the main body 2 (here, the connection case 11) and the other end is fixed to the lower surface of the head unit 3 (here, the head case 32), thereby always generating biasing force against the head unit 3 in a direction where the head unit 3 is away from the main body 2 (that is, a direction where the tilting angle θ increases). The biasing member 9, without being limited to the coil spring, may be configured by using a wire spring, an elastic material (for example, a rubber member) and the like.

Here, it is preferable that the biasing member 9 be set to have the biasing force which enables the head unit 3 to be tilted by the reaction force generated when the shaving surface of the head unit 3 is pressed against the user's skin.

According to the above-described configuration, it is possible to solve a problem as in the rotary electric shaver in the related art, in which large force (applying force) is required for tilting the head unit when in use and consequently the tilting operation of the head unit cannot be smoothly performed particularly when the applying force is small. That is, in the present embodiment, even if the reaction force generated when the shaving surface of the head unit 3 is pressed against the user's skin is weak, it is possible to smoothly tilt the head unit 3. Accordingly, it is possible to improve the ability of the shaving surface (upper surface of the outer blade) of the head unit to match the user's skin. Therefore, it is possible to significantly improve the shaving performance and the shaving comfort.

As described above, according to the rotary electric shaver 1 of the invention, it is possible to allow the head unit 3 to have a wide operation range (angular range) for the tilting operation, and it is possible to smoothly tilt the head unit 3 by using smaller force. This enables the shaving surface of the head unit 3 to be properly tilted along a curved surface of the skin and to come into close contact with the skin, thereby improving the ability to match the user's skin. In this manner, it is possible to improve the shaving performance and the shaving comfort.

Without being limited to the above-described embodiment, the present invention can be modified in various ways without departing from the scope of the present invention. In particular, although the rotary electric shaver having three sets of the blade unit has been described as an example, the present invention is not limited thereto, and can also be applied to a rotary electric shaver having a plurality of sets of the blade unit (for example, four sets, five sets and the like).

What is claimed is:

1. A rotary electric shaver, in which a plurality of blade units that include an outer blade having an annular shaving surface on an upper surface and an inner blade rotating in sliding contact with a lower surface of an outer blade are arranged in a head unit held by a main body so as to be tiltable, wherein a main drive shaft outputting a drive force of a motor accommodated in the main body extends from the main body and is connected on a same line to a rotary shaft of any one blade unit out of the plurality of blade units on a central axis of the rotary shaft by a movable joint, whereby the rotary shaft is directly driven through the movable joint by the main drive shaft, and wherein a position of the movable joint serves as a tilting fulcrum for tilting the head unit, said head unit being held to be tiltable within a predetermined angular range with respect to the main body, and wherein a biasing member is provided which biases the head unit to be located at a position where a tilting angle of the head unit with respect to the main body is maximized, said biasing member holding the head unit in said maximized position with respect to the main body without the help of an operator.

2. The rotary electric shaver according to claim 1, wherein the biasing member is set to have biasing force which enables the head unit to be tilted by reaction force generated when the shaving surface of the head unit is pressed against a user's skin.

3. The rotary electric shaver according to claim 2, wherein the rotary shaft of said one blade unit out of the plurality of blade units to which the main drive shaft is connected and rotary shafts of the other blade units are connected via a connection gear.

4. The rotary electric shaver according to claim 1, wherein the rotary shaft of said one blade unit out of the plurality of blade units to which the main drive shaft is connected and rotary shafts of the other blade units are connected via a connection gear.

5. The rotary electric shaver according to claim 1, wherein the structural cooperation of the main drive shaft, the rotary shaft of any one blade unit out of a plurality of blade units, and the movable joint, is effective in achieving a wide operational range for tilting the head unit.

* * * * *